United States Patent [19]

Schwartz et al.

[11] 4,437,822

[45] Mar. 20, 1984

[54] RADIAL SEALING MEANS FOR USE WITH, AND IN COMBINATION WITH, A SLOTTED ROTOR

[75] Inventors: Jeremy Schwartz, Somerset; Raymond Frick, West Windsor Township, Mercer County, both of N.J.

[73] Assignee: Ingersoll-Rand Company, Woodcliff Lake, N.J.

[21] Appl. No.: 333,996

[22] Filed: Dec. 23, 1981

[51] Int. Cl.[3] ..... F01C 19/02; F04C 27/00

[52] U.S. Cl. ..... 418/122

[58] Field of Search ..... 418/122, 123, 248, 266, 418/267; 267/158

[56] References Cited

U.S. PATENT DOCUMENTS

| | | | |
|---|---|---|---|
| 2,463,118 | 3/1949 | Moore | 418/266 |
| 2,762,346 | 9/1956 | White | 418/123 |
| 3,915,600 | 10/1975 | Lamm | 418/122 |
| 3,981,644 | 9/1976 | Blum | 418/122 |
| 3,989,425 | 11/1976 | Walker | 418/266 |
| 4,104,011 | 8/1978 | Ernest | 418/123 |

*Primary Examiner*—Leonard E. Smith
*Assistant Examiner*—Jane E. Obee
*Attorney, Agent, or Firm*—B. J. Murphy

[57] ABSTRACT

In the preferred embodiment, the invention comprises a sealing arrangement in which an elongated slat-type seal is provided for slidable engagement within the slot of a rotor (such as a Wankel engine-type rotor, or the rotor in a vane-type compressor) and includes a leaf spring for biasing the seal outwardly from the slot to effect fluid sealing externally of the rotor. The leaf spring and seal have special, mutually-engaging keying configurations, and the spring has particularly determined contact points which maintain all possible biasing force therein for the longest service time thereof.

49 Claims, 7 Drawing Figures

FIG. 1
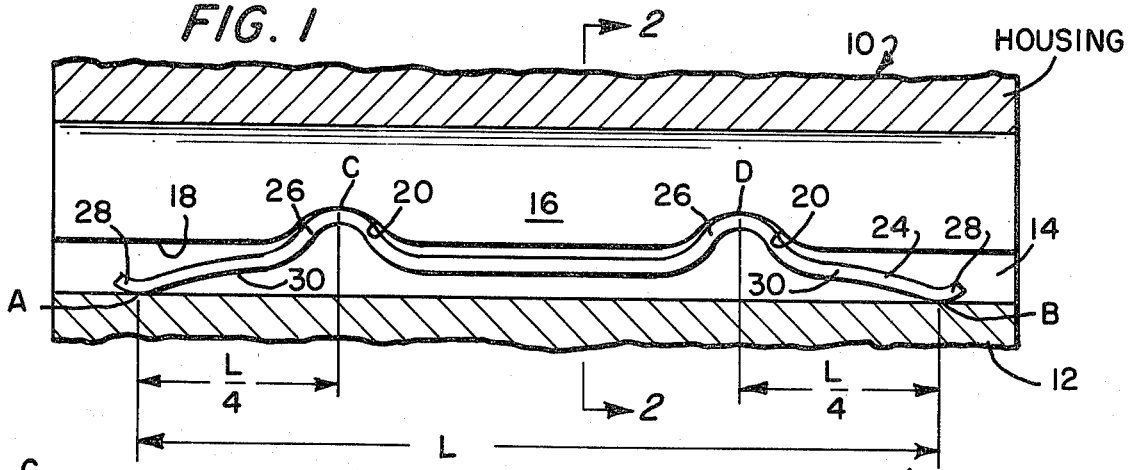
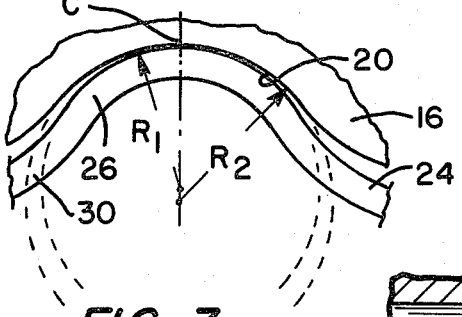
FIG. 3
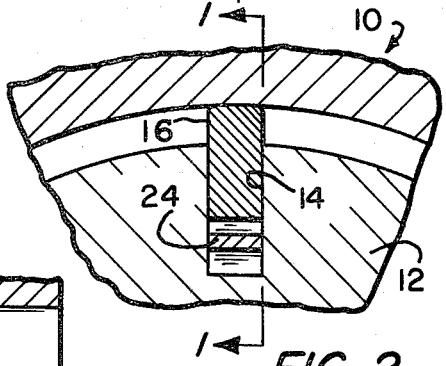
FIG. 2
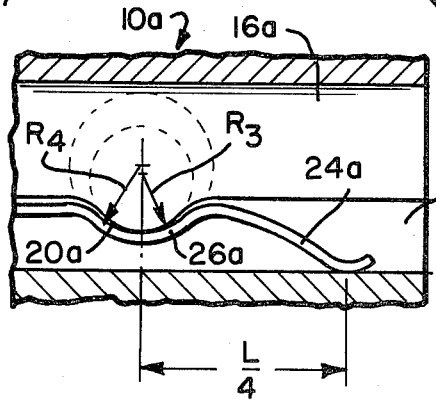
FIG. 4
FIG. 5
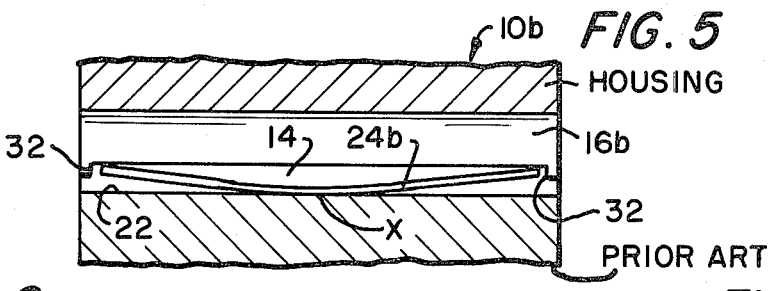
FIG. 6
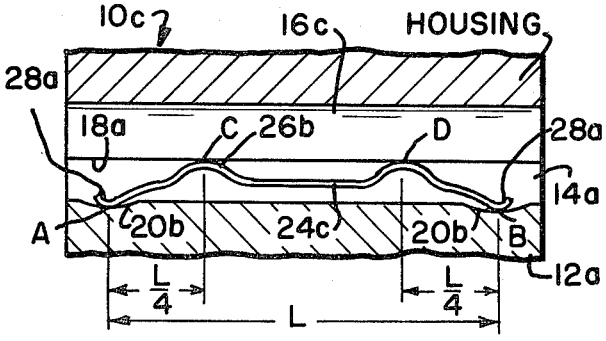
FIG. 7
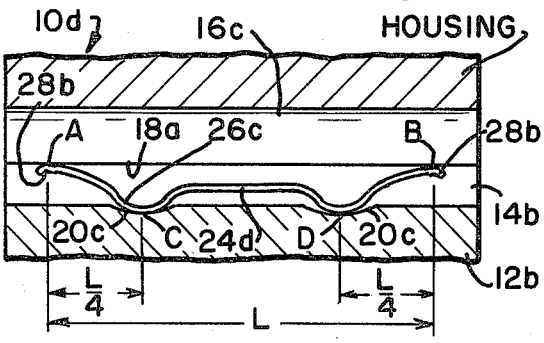

RADIAL SEALING MEANS FOR USE WITH, AND IN COMBINATION WITH, A SLOTTED ROTOR

This invention pertains to radial sealing means, and the like, used particularly in rotors having slots defined for such sealing means. Particularly, the invention comprises an elongate seal for slidable disposition within the slot of a rotor and a leaf-type spring for urging the seal outwardly from the slot to effect sealing engagement with the wall of a housing in which the rotor is journalled.

In the Wankel-type rotary engine, for example, the apex sealing arrangement comprises a slat or thin, elongate element that slidably rides on a spring in a slot in the rotor. Stress in the spring may not exceed an allowable level when, in its most compressed state, the spring exerts its maximum force. On the other hand, long-term operation of the apex seal arrangement requires that the spring force diminish as little as possible with time, as the apex seal wears away, and the spring deflection decreases.

What has been needed, then, in this art, is a radial sealing means, for use such as an aforesaid apex sealing arrangement, in which the spring force thereof which is lost with time, as the apex seal wears away, and the spring deflection decreases, is the least possible, for a spring, on such a radial sealing means, of a given, constant (i.e., uniform) cross-section, with a given allowable stress level, and a prescribed maximal force.

It is an object of this invention to provide such an aforesaid, durable and improved radial sealing means.

It is also an object of this invention to set forth, for use with a rotor having a substantially radial slot formed therein, which slot extends axially of the rotor, radial sealing means, for insertion in said slot for effecting fluid sealing externally of said rotor, comprising: first means comprising an elongate element, such as a seal, a vane, or the like, for slidable disposition and radial movement, of at least a portion thereof, within said rotor slot; and second means, for interpositioning thereof between said first means and said slot, for biasing said first means outwardly relative to said slot; wherein said first and second means have keying means cooperative for constraining said first and second means against a relative longitudinal or axial movement therebetween; said second means comprises a leaf spring of a given length; and said elongate element has an inner surface, of approximately said given length, for confrontingly engaging said leaf spring; one of said first and second means has means defining a keyway therein; and the other of said first and second means has means defining a key thereon; said key and keyway being defined intermediate said given lengths of said leaf spring and said inner surface, and having points of mutual contacting engagement which maintains a given, unaltering, radial alignment therebetween during slidably radial movement of said element in said slot.

It is another object of this invention to set forth, in combination with a rotor for rotation within a walled housing, said rotor having a substantially radial slot formed therein, which slot extends axially of the rotor, radial sealing means, for insertion in said slot for effecting fluid sealing between said rotor and a wall of the housing, comprising: first means comprising an elongate element, such as a seal, a vane, or the like, having at least a portion thereof slidably disposed within said rotor slot for radial movement therewithin; and second means, interpositioned between said first means and said slot, biasing said first means outwardly relative to said slot, wherein said first and second means have keying means which cooperatively constrain said first and second means against a relative longitudinal or axial movement therebetween; said second means comprises a leaf spring of a given length; and said elongate element has an inner surface, of approximately said given length, which confrontingly engages said leaf spring; one of said first and second means has means defining a keyway therein; and the other of said first and second means has means defining a key thereon; said key and keyway being defined intermediate said given lengths of said leaf spring and said inner surface, and having points of mutual contacting engagement which maintain a given, unaltering, radial alignment therebetween during slidably radial movement of said element in said slot.

Further objects of this invention, as well as the novel features thereof, will become more apparent by reference to the following description taken in conjunction with the accompanying figures, in which:

FIG. 1 is a cross-sectional view in elevation of a preferred embodiment of the invention, taken along section 1-1 of FIG. 2;

FIG. 2 is a cross-sectional view in elevation, of the FIG. 1 embodiment, taken along section 2-2 of FIG. 1;

FIG. 3 is an enlarged detail illustrating the diverse radii of the arcuate, bent portions of the spring, and the arcuate recesses of the elongate seal;

FIG. 4 is a fragmentary view, similar to that of FIG. 1, showing an alternative embodiment of the invention;

FIG. 5 is a view, like that of FIG. 1, showing a typical, prior art sealing means; and FIGS. 6 and 7 are cross-sectional views, in elevation, of two further alternative embodiments of the invention.

As shown in FIGS. 1 through 3, the novel radial sealing means 10 is shown in use with a rotor 12 having a groove or slot 14 radially formed into the periphery thereof. The slot 14 receives an elongate, substantially flat or slat-type seal 16 slidably therein. The underlying surface 18 of the seal, that is, the edge which confronts the bottom of the slot 14, has a pair of spaced-apart recesses 20 formed therein. The recesses 20 are defined (in part) by a radius "R1". In engagement with the recesses 20, and interpositioned in the slot 14 between the seal 16 and the base 22 of the slot 14 is a leaf spring 24. The spring 24 has complementary bent, arcuate portions 26, spaced aprt, for engaging the recesses 20 in the seal 16. The bent, arcuate portions of the spring 24 are defined (in part) by a radius "R2".

It is to be noted that the radii "R1" and "R2" are different. This is so that, with translation of the seal 16 within the slot 14, the opposite sides of the bent, arcuate portions 26 of the spring may expand and contract to accommodate the spring flexure. Radius "R1" is shorter than radius "R2". The recesses 20 provide spaces in which the aforesaid expanding and contracting sides may move without inhibiting seal translation. The terminal ends 28 of the spring 24 are slightly upturned, in order that they will not score the base 22 of the slot 14 unduly.

The spring 24 makes contact with the base 22 of the slot 14 between points "A" and "B" whereat the end limbs 30 of the spring 24 effect a substantially line contact. The distance between points "A" and "B" is "L". About one-quarter of that distance "L", and inwardly from either ends of the spring 24, are points "C"

and "D" where the bent, arcuate portions 26 of the spring 24 again make a substantially line contact with the seal 16. As a consequence, with translation of the seal 16 within the slot 14, the ends 28 of the spring 24 exhibit a slidable, axial movement along the base 22 of the slot 14, and remove any carbon deposits, and the like, which otherwise could build up therein. Also, having contacts "A" and "C", and "B" and "D" of the spring 24, between the base 22 of the slot 14 and the underlying surface 18 of the seal, at one-quarter the effective length "L" of the spring, insures the most extended, useful life for the spring as will be possible.

Spring contacts "A" and "B", as will be appreciated, are subject to movement. However, contacts "C" and "D" are not. The latter maintain a given, unaltering contact, and radial alignment with the midpoint of the recesses, regardless of the translations of the seal 16 in the slot 14.

The arcuate, bent portions 26 of the spring 24 comprise keys which nestably engage the recesses 20 in the seal 16. The recesses 20, then, comprise keyways which keep the spring 24 in optimum, radial positioning.

In FIG. 4 the alternative embodiment has similar index numbers to denote similar structures as in FIGS. 1 through 3. This embodiment 10*a* carries out the same basic principal as practiced in embodiment 10, except that here in lieu of arcuate recesses in the underlying surface of the seal 16*a* there are arcuate prominences 20*a* for engagement with the arcuate, bent portions 26*a* of the spring 24*a*. Again, said bent portions 26*a* are formed one-quarter of the length inboard from the slot-contacting points of the spring 24*a*. In this arrangement, however, the radius "R4" of the bent portions 26*a* of the spring 24*a*, and the radius "R3" and of the arcuate prominences 20*a* of the seal 16*a* are reversed. That is, the spring bent portion 26*a* has a greater radius than the prominences 20*a*.

The particular improvement of the invention proceeds from having the spring rotor contacts "A" and "B" near the ends of the spring 24 (or 24*a*) and the two spring seal contacts "C" and "D" each located at a distance (from a spring rotor contact ("A" or "B") equal to one-quarter of the distance "L" between the two spring rotor contacts ("A", "B"). The decrease of spring force (with seal wear) of this spring 24 will be $\sqrt{2}/2=0.7$ of that of a comparable spring 24*b* of the prior art type 10*b* (shown in FIG. 5).

The spring 24 (or 24*a*) has no point stationary with respect to the rotor 12. Its rotor contacts "A" and "B" slide when it deflects. Around the stationary point "X" of the prior art spring 24*b*, carbon deposits develop, tending to restrict its deflection in operation, and to make more difficult the disassembly of the machine (in which the rotor is used) during overhaul.

The seal 16 neither has nor needs corner tabs, such as tabs 32 in seal 16*b* (FIG. 5), to keep the spring 24 in place. These corner tabs 32, in prior art arrangements, have been subject to breakage. In our novel sealing means 10 or 10*a*, the spring 24 or 24*a* is positioned by the aforesaid key and keyway, complementary configurations of the seals 16 and 16*a*, and springs 24 and 24*a*.

All of the contacts "A", "B", "C" and "D" occur through generous radii (as illustrated) that distribute the contact stresses; this avoids surface damage to the seals 16 and 16*a*, springs 24 and 24*a*, and rotor slot 14. The sharp cornered, end contacts of spring 24*b* (FIG. 5) gouge the seal 16*b*.

The alternative embodiment 10*c*, shown in FIG. 6, employs the same keying arrangement as already described, except that the keyways are not formed in the seal 16*c*. Alternatively, the slot 14*a* of the rotor 12*a* has recesses 20*b* set apart, between the centers thereof, the aforesaid distance "L". In this arrangement, the spring 24*c* simply has the bent ports 26*b* riding on the underlying, linear surface 18*a* of the seal 16*c*. This arrangement is less preferred than those of FIGS. 1 and 4 in that there is considerably less travel of the spring ends 28*a* relative to the rotor 12*a*. Accordingly, there can be, or there may be, some minimal build up of carbon residue within the recesses 20*b*. However, it will be appreciated that there will be some slidable movement of the ends 28*a* of the spring 24*c* in the recesses 20*b*; thus, any carbon build up shall not to be excessive.

The alternative embodiment 10*d*, shown in FIG. 7, is substantially the inverse of the arrangement shown in FIG. 1. Here again, the slot 14*b* of the rotor 12*b* has recesses 20*c* formed therein to receive the bent portions 26*c* of the spring 24*d*. Again, the end portions 28*b* of the spring 24*d* simply ride upon the linear, underlying surface 18*a* of the seal 16*c*, and the bent portions 26*c*, of the spring, do not move axially relative to the rotor 12*b*. This arrangement is even less efficient than those of the embodiments in FIGS. 1, 4 and 6. However, it is a novel way of retaining the spring 24*d*, axially, between the seal 16*c* and the rotor 12*b*, to keep the spring from engaging the sides (not shown) of the housing.

While we have described our invention in connection with specific embodiments thereof, it is to be clearly understood that this is done only by way of example, and not as a limitation to the scope of our invention as set forth in the objects thereof and in the appended claims.

We claim:

1. For use with a rotor having a substantially radial slot formed therein, which slot extends axially of the rotor, radial sealing means, for insertion in said slot for effecting fluid sealing externally of said rotor, comprising:

first means comprising an elongate element, such as a seal, a vane, or the like, for slidable disposition and radial movement, of at least a portion thereof, within said rotor slot; and second means, for interpositioning thereof between said first means and said slot, for biasing said first means outwardly relative to said slot; wherein said first and second means have keying means cooperative for constraining said first and second means against a relative longitudinal or axial movement therebetween in either of opposite longitudinal or axial directions;

said second means comprises a leaf spring of a given length; and said elongate element has an inner surface, of approximately said given length, for confrontingly engaging said leaf spring;

one of said first and second means has means defining keyways therein; and the other of said first and second means has means defining keys thereon;

said keys and keyways being defined intermediate said given lengths of said leaf spring and said inner surface, and defining a pair of points of mutual contacting engagement which maintain a given, unaltering, radial alignment therebetween during slidably radial movement of said element in said slot.

2. Radial sealing means, according to claim 1, wherein:

said leaf spring has a limb which, in response to slidably radial movement of sid element in said slot, moves axially in, and relative to, the base of said slot.

3. Radial sealing means, according to claim 2, wherein:

said limb comprises an end of said spring;

said limb has a termination with a configuration for isolating said termination from contact with said base of said slot.

4. Radial sealing means, according to claim 2, wherein:

said limb defines an end of said spring and has a portion, intermediate the length thereof, which, in response to slidably radial movement of said element in said slot, slidably moves along said base of said slot.

5. Radial sealing means, according to claim 1, wherein:

said leaf spring has an intermediate portion, and limb portions on opposite ends thereof; and said intermediate portion is joined to said limb portions by intervening arcuate portions.

6. Radial sealing means, according to claim 5, wherein:

said arcuate portions each have one of said points of mutual contacting engagement which biasingly engage said elongate element.

7. Radial sealing means, according to claim 1, wherein:

said inner surface of said elongate element has an intermediate portion, and end portions at opposite ends thereof; and arcuate portions join said intermediate portion and said end portions.

8. Radial sealing means, according to claim 7, wherein:

said arcuate portions of said inner surface each have one of said points of mutual contacting engagement which are biasingly engaged by said leaf spring.

9. Radial sealing means, according to claim 5, wherein:

said intervening arcuate portions define a pair of said keys.

10. Radial sealing means, according to claim 7, wherein:

said arcuate portions of said inner surface define a pair of said keyways.

11. Radial sealing means, according to claim 4, wherein:

said leaf spring has a pair of said limbs, one of said limbs of said pair defining one end of said spring, and another limb of said pair defining the other end of said spring;

each of said limbs having a region on a surface thereof configured to make slidable, substantially line contact with said base of said slot;

the distance obtaining between said regions of said limbs comprising a given dimension;

said inner surface of said elongate element has an intermediate portion and end portions at opposite ends thereof, and arcuate portions join said intermediate portion and said end portions; and radial lines drawn through and bisecting said arcuate portions of said inner surface are spaced apart a distance which is substantially exactly half said given dimension.

12. Radial sealing means, according to claim 11, wherein:

said leaf spring further has an intermediate portion, and arcuate portions joining said limbs to said intermediate portion; and radial lines drawn through and bisecting said arcuate portions of said leaf spring are spaced apart a distance which is substantially exactly half said given distance.

13. Radial sealing means, according to claim 12, wherein:

each arcuate portion of said inner surface is defined, in part, by a given radius; and each arcuate portion of said spring is defined, in part, by a radius other than said given radius.

14. Radial sealing means, according to claim 13, wherein:

said given and other radii have radial centers which are spaced apart from each other.

15. Radial sealing means, according to claim 13, wherein:

said given radius is greater than said other radius.

16. Radial sealing means, according to claim 13, wherein:

said given radius is smaller than said other radius.

17. In combination with a rotor for rotation within a walled housing, said rotor having a substantially radial slot formed therein, which slot extends axially of the rotor, radial sealing means, for insertion in said slot for effecting fluid sealing between said rotor and a wall of the housing, comprising:

first means comprising an elongate element, such as a seal, a vane, or the like, having at least a portion thereof slidably disposed within said rotor slot for radial movement therewithin; and second means, interpositioned between said first means and said slot, biasing said first means outwardly relative to said slot; wherein said first and second means have keying means which cooperatively constrain said first and second means against a relative longitudinal or axial movement therebetween in either of opposite longitudinal or axial directions;

said second means comprises a leaf spring of a given length; and said elongate element has an inner surface, of approximately said given length, which confrontingly engages said leaf spring;

one of said first and second means has means defining keyways therein; and the other of said first and second means has means defining keys thereon;

said keys and keyways being defined intermediate said given lengths of said leaf spring and said inner surface, and defining a pair of points of mutual contacting engagement which maintain a given, unaltering, radial alignment therebetween during slidably radial movement of said element in said slot.

18. The combination, according to claim 17, wherein:

said leaf spring has a limb which, in response to slidably radial movement of said element in said slot, moves axially in, and relative to, the base of said slot.

19. The combination, according to claim 18, wherein:
said limb comprises an end of said spring;
said limb has a termination with a configuration which isolates said termination from contact with said base of said slot.

20. The combination, according to claim 18, wherein:
said limb defines an end of said spring and has a portion, intermediate the length thereof, which, in response to slidably radial movement of said element in said slot, slidably moves along said base of said slot.

21. The combination, according to claim 19, wherein:
said leaf spring has an intermediate portion, and limb portions on opposite ends thereof; and
said intermediate portion is joined to said limb portions by intervening arcuate portions.

22. The combination, according to claim 21, wherein:
said arcuate portions each have one of said points of mutual contacting engagement which biasingly engage said elongate element.

23. The combination, according to claim 17, wherein:
said inner surface of said elongate element has an intermediate portion, and end portions at opposite ends thereof; and
arcuate portions join said intermediate portion and said end portions.

24. The combination, according to claim 23, wherein:
said arcuate portions of said inner surface each have one of said points of mutual contacting engagement which are biasingly engaged by said leaf spring.

25. The combination, according to claim 21, wherein:
said intervening arcuate portions define a pair of said keys.

26. The combination, according to claim 23, wherein:
said arcuate portions of said inner surface define a pair of said keyways.

27. The combination, according to claim 20, wherein:
said leaf spring has a pair of said limbs, one of said limbs of said pair defining one end of said spring, and another limb of said pair defining the other end of said spring;
each of said limbs having a region on a surface thereof which makes slidable, substantially line contact with said base of said slot;
the distance obtaining between said regions of said limbs comprising a given dimension;
said inner surface of said elongate element has an intermediate portion and end portions at opposite ends thereof, and arcuate portions join said intermediate portion and said end portions; and
radial lines drawn through and bisecting said arcuate portions of said inner surface are spaced apart a distance which is substantially exactly half said given dimension.

28. The combination, according to claim 27, wherein:
said leaf spring further has an intermediate portion, and arcuate portions joining said limbs to said intermediate portion; and
radial lines drawn through and besecting said arcuate portions of said leaf spring are spaced apart a distance which is substantially exactly half said given distance.

29. The combination, according to claim 28, wherein:
each arcuate portion of said inner surface is defined, in part, by a given radius; and
each arcuate portion of said spring is defined, in part, by a radius other than said given radius.

30. The combination, according to claim 29, wherein:
said given and other radii have radial centers which are spaced apart from each other.

31. The combination, according to claim 29, wherein:
said given radius is greater than said other radius.

32. The combination, according to claim 29, wherein:
said given radius is smaller than said other radius.

33. In combination with first means which defines a rotor, for rotation within a walled housing, said rotor having a substantially radial slot formed therein, which slot extends axially of the rotor, radial sealing means, for insertion in said slot for effecting fluid sealing between said rotor and a wall of the housing, comprising:
an elongate element, such as a seal, a vane, or the like, having at least a portion thereof slidably disposed within said rotor slot for radial movement therewithin; and
second means, interpositioned between said elongate element and said slot, biasing said element outwardly relative to said slot; wherein
said first and second means have keying means for cooperatively constraining said second means against a longitudinal or axial movement thereof relative to said first means in either of opposite longitudinal or axial directions;
said second means comprises a leaf spring of a given length; and
said elongate element has an inner surface, of approximately said given length, for confrontingly engages said leaf spring;
one of said first and second means has means defining keyways therein; and
the other of said first and second means has means defining keys thereon;
said keys and keyways being defined intermediate said given lengths of said leaf spring and said inner surface, and defining a pair of points of mutual contacting engagement which maintain a given, unaltering, radial alignment therebetween during slidably radial movement of said element in said slot.

34. The combination, according to claim 33, wherein:
said leaf spring has a limb which, in response to slidably radial movement of said element in said slot, moves axially along, and relative to, said inner surface of said element.

35. The combination, according to claim 34, wherein:
said limb comprises an end of said spring;
said limb has a termination with a configuration which isolates said termination from contact with said element.

36. The combination, according to claim 35, wherein:
said leaf spring has an intermediate portion, and limb portions on opposite ends thereof; and
said intermediate portion is joined to said limb portions by intervening arcuate portions.

37. The combination, according to claim 36, wherein:
said arcuate portions each have one of said points of mutual contacting engagement which biasingly engage said rotor.

38. The combination, according to claim 33, wherein:
said slot has an innermost or bottom surface having a linear, intermediate portion, and linear, end portions at opposite ends thereof; and
arcuate, recessed portions join said intermediate portion and said end portions.

39. The combination, according to claim 38, wherein:
said arcuate, recessed portions of said innermost or bottom surface each have one of said portions of mutual contacting engagement which are engaged by said leaf spring.

40. The combination, according to claim 36, wherein: said intervening arcuate portions define a pair of said keys.

41. The combination, according to claim 38, wherein: said arcuate, recessed portions of said inner surface define a pair of said keyways.

42. The combination, according to claim 34, wherein: said leaf spring has a pair of said limbs, one of said limbs of said pair defining one end of said spring, and another limb of said pair defining the other end of said spring;

each of said limbs having a region on a surface thereof which makes slidable, substantially line contact with said inner surface of said element;

the distance obtaining between said regions of said limbs comprising a given dimension; and radial lines drawn through and bisecting said arcuate, recessed portions of said innermost or bottom surface are spaced apart a distance which is substantially exactly half said given dimension.

43. The combination, according to claim 42, wherein: said leaf spring further has an intermediate portion, and arcuate portions joining said limbs to said intermediate portion; and radial lines drawn through and bisecting said arcuate portions of said leaf spring are spaced apart a distance which is substantially exactly half said given distance.

44. The combination, according to claim 43, wherein: said slot has an innermost or bottom surface having a linear, intermediate portion, and linear, end portions at opposite ends thereof; and arcuate, recessed portions join said intermediate portion and said end portions; and wherein each arcuate, recessed portion of said innermost or bottom surface is defined, in part, by a given radius; and each arcuate portion of said spring is defined, in part, by a radius other than said given radius.

45. The combination, according to claim 44, wherein: said given and other radii have radial centers which are spaced apart from each other.

46. The combination, according to claim 44, wherein: said given radius is greater than said other radius.

47. In combination, first means defining a rotor for rotation within a walled housing, said rotor having a substantially radial slot formed therein, which slot extends axially of the rotor, radial sealing means, for insertion in said slot for effecting fluid sealing between said rotor and a wall of the housing, an elongate element, such as a seal, a vane, or the like, having at least a portion thereof slidably disposed within said rotor slot for radial movement therewithin; and second means, interpositioned between said element and said slot, biasing said element outwardly relative to said slot; wherein:

said first and second means have keying means for cooperatively constraining said second means against a longitudinal or axial movement thereof relative to said element in either of opposite longitudinal or axial directions; said second means comprises a leaf spring of a given length; and said elongate element has an inner surface, of approximately said given length, which confrontingly engages said leaf spring;

one of said first and second means has means defining keyways therein; and the other of said first and second means has means defining keys thereon;

said element and said leaf spring have a pair of points of mutual contacting engagement which maintain a given, unaltering, radial alignment therebetween during slidably radial movement of said element in said slot.

48. The combination, according to claim 47, wherein: said leaf spring has a limb which, in response to slidably radial movement of said element in said slot, moves relative to the base of said slot.

49. The combination, according to claim 47, wherein: said limb comprises an end of said spring;

said limb has a termination with a configuration which isolates said termination from contact with said base of said slot.

* * * * *